United States Patent [19]

Kitagawa et al.

[11] 4,308,799

[45] Jan. 5, 1982

[54] DRY PLANOGRAPHIC PRINTING PLATE

[75] Inventors: Takao Kitagawa, Shiga; Shigeo Abiko; Tadami Kamaishi, both of Ootsu, all of Japan

[73] Assignee: Toray Industries, Inc., Tokyo, Japan

[21] Appl. No.: 201,087

[22] Filed: Oct. 27, 1980

[30] Foreign Application Priority Data

Oct. 25, 1979 [JP] Japan ..... 54-138150

[51] Int. Cl.[3] ..... B41N 1/00

[52] U.S. Cl. ..... 101/457; 428/447

[58] Field of Search ..... 428/447; 101/457

[56] References Cited

U.S. PATENT DOCUMENTS 4,020,761 5/1977 Ogiwara ..... 428/447 X 4,111,890 9/1978 Getson ..... 428/447 X 4,179,295 12/1979 Takamzawa ..... 428/447

*Primary Examiner*—John D. Welsh

*Attorney, Agent, or Firm*—Scully, Scott, Murphy & Presser

[57] ABSTRACT

Provided is a dry planographic printing plate containing on a base substrate a mixture which mixture comprises an organopolysiloxane; an alkoxy silane as a cross-linking agent represented by the formula $R_{4-a-b}R'_aSi(OR'')_b$ wherein a is 0 or 1, b is 2 or 3 and a+b is at most 3, R is an organic group containing a polar group or double bond and OR'' is an alkoxy group; and a compound as a cross-linking catalyst represented by the formula $(R^1O)(R^2O)(R^3O)(R^4O)M$ wherein M is titanium or zirconium, $R^1$, $R^2$, $R^3$ and $R^4$ are each an organic group.

11 Claims, No Drawings

DRY PLANOGRAPHIC PRINTING PLATE

BACKGROUND OF THE INVENTION

This invention relates to a dry planographic printing plate whereby printing can be effected without dampening water. More specifically it relates to a dry planographic printing plate suitable for an in-house or in-plant printing.

There has long been applied widely and practically a planographic printing method using dampening water in which image area and non-image area are distinguished from each other by a physicochemical difference based on the intervention of water and the reproduction of image is effected. This method, however, has various drawbacks caused by using water, and, in order to solve the drawbacks, there have been proposed various dry planographic printing methods requiring no dampening water.

The dry planographic printing plate used in these proposed methods operates by distinguishing image area from non-image area by coating the non-image area on the printing plate with an ink repellent substance, e.g. an organosilicone polymer or an organofluorine compound. In a method for selectively forming an ink repellent area in the non-image area, a printing plate composed of a base substrate, a photosensitive layer and an ink repellent substance layer is image-wise exposed to the light and the exposed area or unexposed area is removed with a developer.

In another method an image is formed with an ink receptive toner by the electrophotography on a printing plate composed of a base substrate and a layer of an ink repellent substance. The latter method is simple in forming an image, and so is suitable for an in-house or in-plant printing, but this method has a serious problem that the durability, printing endurance of the printing plate, is much inferior to a printing plate using dampening water, because the toner image does not firmly adhere to the surface of an ink repellant substance.

In Japanese Patent Laid Open Publication No. 29305/1977 it is proposed that an organopolysiloxane having a reactive organic group can be effectively used as the ink repellant layer. According to this proposed method, background contamination in non-image area and printing endurance are remarkably improved. Nevertheless there still remains a problem in the balance between background contamination and printing endurance so this method is not yet considered satisfactory for practical application. Moreover, an organosiloxane having a reactive organic group is expensive and the use thereof is uneconomical. On the other hand, Japanese Patent Laid Open Publication No. 1803/1975 proposes that an organopolysiloxane which constitutes the ink repellent layer be modified for example with polystyrene and that a heterogeneous polymer be used comprising an ABA type tri- or multi-block polymer. Further, in Japanese Patent Laid Open Publication No. 66008/1976 there is proposed the use of a block polymer consisting of a siloxane block and a thermoplastic organic block as an ink repellent elastomer layer. Printing plate surfaces made according to these proposed methods exhibit a fairly improved adhesion to toner as compared with a printing plate surface consisting of an unmodified organopolysiloxane alone, but are still unsatisfactory for practical application in view of the balance between background contamination and printing endurance (in general, there is an inverse correlation such that if background contamination is remedied the printing endurance lowers, and if the printing endurance is improved the background contamination becomes worse). Besides, since for the production of those modified polymers a peculiar polymerization method should be employed, such substances for printing plate surface are not satisfactory also from the economic point of view.

In Japanese Patent Laid Open Publication No. 76104/1977 there is proposed the use of a solid fluoro-compound copolymer as an ink repellent substance. As a result of using a fluoro-compound copolymer, the adhesion to toner is improved, but the printing plate surface becomes less repellent against ink, so that it becomes necessary to give consideration to the printing machine and the printing paper and therefore, it is not easy to obtain a printed matter free from background contamination. In addition, a fluoro-compound is costly to manufacture and the use thereof is uneconomical.

Organopolysiloxanes and organofluorine compounds exhibit a repellent property against ink but at the same time do not allow an image-forming substance, e.g. toner, to adhere securely thereto, thus forming a printing plate surface of a low printing endurance and unsatisfactory for practical application. If an organopolysiloxane is further modified to enhance its bonding force to an image-forming substance, it becomes less repellent against ink, and background contamination easily occurs. A dry planographic printing ink, in general, is different from a planographic printing ink using a dampening water, and it is impossible to allow the latter to serve also as the former. For effectively using a printing plate which is liable to cause background contamination, it is necessary to give some consideration to ink as one measure, but it is difficult to design an ink maintaining its characteristics such as tack, flow and stability which is convenient for use. A dry planographic printing plate which can maintain the adhesion of toner strongly without lowering the ink repellency on the plate surface, if available, would be extremely convenient from the standpoint of both production and use of ink.

It is an object of this invention to solve the above-mentioned problems associated with the prior art.

It is another object of this invention to provide a dry planographic printing plate for direct image forming superior in both ink repellency and toner adhesion.

Other objects and advantages of this invention will become apparent from the following description.

SUMMARY OF THE INVENTION

The foregoing objects of this invention can be attained by a dry planographic printing plate which comprises a base substrate and an ink repellent silicone layer overlying the substrate, said silicone layer comprises a mixture of (A) an organopolysiloxane;

(B) an alkoxy silane represented by the formula $$R_{4-a-b}R'_aSi(OR'')_b$$

wherein R is an organic group having 1 to 18 carbon atoms which contains a member selected from the group consisting of an olefinically unsaturated hydrocarbon group, an aromatic hydrocarbon group and a polar group which does not react with the OR'' at room temperature, R' is an alkyl or alicyclic group having 1 to 18 carbon atoms, OR'' is an alkoxy group having 1 to 8 carbon atoms, a is 0 or 1, b is 2 or 3, and a+b is at most 3; and (C) a titanium or a zirconium compound represented by the formula $$(R^1O)(R^2O)(R^3O)(R^4O)M$$

wherein $R^1$, $R^2$, $R^3$, $R^4$ are each an organic group having 1 to 18 carbon atoms or an organic group having 1 to 18 carbon atoms containing a residue of >C=O,

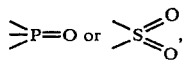

by which the group is bonded to the oxygen atom, and M is titanium or zirconium.

DETAILED DESCRIPTION OF THE INVENTION

The dry planographic printing plate of this invention is characterized in that on the base substrate is formed a layer which contains as the principal component a reaction mixture resulting from the reaction of an organic alkoxy silane cross-linking agent (B), a titanium or zirconium compound (C) having an organic group attached by metal-oxygen bond, and an organopolysiloxane.

The organopolysiloxane used as the component (A) in this invention generally indicates a resin in which an organosilicon group with an attached hydrocarbon group such as methyl, ethyl, vinyl or phenyl is condensed by the siloxane bond. Essentially there may be used any organopolysiloxanes if only they have a silanol group at one or both ends, typical of which are diorganopolysiloxanes such as dimethyl polysiloxane. Furthermore, an organosilicon group containing a polar group or a reactive organic group may be co-condensed to organopolysiloxane on condition that it does not cause background contamination in printing. In some cases an organopolysiloxane may be used in which an organosilicon group containing a polar group is condensed by the siloxane bond, or a compound containing a polar group is bonded by reaction to the organopolysiloxane. As the polar group, the following may be used amino, epoxy, hydroxyl, carboxyl, aldehyde, mercapto, halogenated derivative, nitrile, and imino. Two or more polar groups may be contained per siloxane monomer unit. In general, however, the introduction of a polar group is apt to cause lowering in ink repellency so, in the case of using an organopolysiloxane having a polar group, it is desirable to use an organopolysiloxane with a polar group not bonded to the main chain. Organopolysiloxane contains a reactive silanol group at one or both ends thereof, and by virtue of this reactive end group the organopolysiloxane reacts with the cross-linking agent and/or the catalyst and is cured.

The cross-linking agent used as the component (B) in this invention is an alkoxy silane represented by the formula $$R_{4-a-b}R'_aSi(OR'')_b$$

wherein a is 0 or 1, b is 2 or 3, and a+b is at most 3. OR'' is an alkoxy group having 1 to 8 carbon atoms, and R is an organic radical having 1 to 18 carbon atoms which contains an olefinically unsaturated hydrocarbon group, an aromatic hydrocarbon group and/or polar group which does not react with the OR'' at room temperature. R' is an alkyl or alicyclic group having 1 to 18 carbon atoms. When b is 3, a should be 0, i.e. no R' group can be exist. When b is 2, a may be 0 or 1. The number of carbon atom of R is not more than 18, and 1 to 12 is particularly preferred. Examples of the OR'' are methoxy, ethoxy, propoxy, butoxy and octoxy.

By way of illustrating the R in the foregoing formula, mention may be made of organic groups containing an olefinically unsaturated hydrocarbon group such as vinyl or allyl, an aromatic hydrocarbon group such as phenyl or tolyl, and/or at least one polar group such as amino, epoxy, acyclic ether, hydroxyl, carboxyl, ester (—COO—), carbonyl, mercapto, halogen or nitrile. As the organic group in the polar group-containing organic group are preferred such hydrocarbon groups as alkyl, cycloalkyl and aryl. Two or more groups selected from an olefinic hydrocarbon group, an aromatic hydrocarbon group and a polar group may be combined together such as γ-methacryloxypropyl, γ-glycidoxypropyl and p-vinylphenyl.

Examples of the R' are methyl, ethyl, propyl, butyl, hexyl, cyclopentyl and cyclohexyl.

By way of illustrating the alkoxy silane, mention may be made of the following as typical examples: γ-methacryloxypropyl trimethoxy silane, γ-acryloxypropyl trimethoxy silane, γ-methacryloxypropyl triethoxy silane, γ-chloro, β-methylpropyl trimethoxy silane, 5-chloropentyl trimethoxy silane, γ-chloropropyl triethoxy silane, γ-chloropropyl trimethoxy silane, γ-mercaptopropyl trimethoxy silane, γ-mercapto, β-methylpropyl trimethoxy silane, γ-mercaptopropyl triethoxy silane, phenyl trimethoxy silane, vinyl trimethoxy silane, trimethoxy (p-vinylphenyl) silane, allyl trimethoxy silane, N,N-dimethyl-3-(trimethoxysilyl)propylamine, N,N-dimethyl-3-(triethoxysilyl)propylamine, γ-glycidoxypropyl trimethoxy silane, β-(3,4-epoxycyclohexyl)ethyl trimethoxy silane, γ-glycidoxypropyl triethoxy silane, γ-(aminoethyl)aminopropyl trimethoxy silane, phenyl methyl diethoxy silane, γ-glycidoxypropyl methyl dimethoxy silane, γ-chloropropyl methyl dimethoxy silane, γ-methacryloxypropyl methyl dimethoxy silane, and γ-mercaptopropyl methyl diethoxy silane. These cross-linking agents may be used alone or in combination of two or more.

The cross-linking agent should be stable under the condition of room temperature, and the substituent groups R and OR' should not substantially react with each other. Further, the cross-linking agent should be soluble in a substantially water-free organic solvent and, in general, silanes having a polar substituent group are preferred, which afford superior results to those wherein R is alkyl or aralkyl. Preferred cross-linking agents are those which on curing alone afford a cured article having a critical surface tension not lower than 25 g/cm, more preferably not lower than 30 g/cm. Particularly preferred examples of the cross-linking agent are γ-glycidoxypropyl trimethoxy silane, γ-chloropropyl trimethoxy silane, γ-mercaptopropyl trimethoxy silane, γ-methacryloxypropyl trimethoxy silane, β-(3,4-epoxycyclohexyl)ethyl trimethoxy silane, and phenyl trimethoxy silane.

Used as the component (C) in this invention are titanate or zirconate compounds in which titanium or zirconium is attached to an organic group through the medium of oxygen atom, represented by the formula $(R^1O)(R^2O)(R^3O)(R^4O)M$ in which M is titanium or zirconium, $R^1$, $R^2$, $R^3$ and $R^4$ may be alike or different, two of which, for example, $R^1$ and $R^2$ may be cyclically bonded together by a chemical bond, and $R^1$, $R^2$, $R^3$ and $R^4$ are each selected from the group consisting of an organic group having 1 to 18 carbon atoms and an organic group having 1 to 18 carbon atoms containing a residue of >C=O,

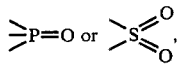

with an organic group having 1 to 12 carbon atoms being particularly preferred, in which the organic group means a hydrocarbon group or a substituted hydrocarbon group, while in the organic group containing a residue of >C=O,

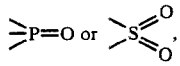

the group bonded to >C=O,

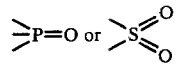

means a hydrocarbon group or a substituted hydrocarbon group. As the hydrocarbon group are mentioned alkyl groups such as methyl, ethyl, propyl, butyl, hexyl, 2-ethylhexyl, octyl and dodecyl, aralkyl groups such as benzyl, alkaryl groups such as dodecylphenyl.

By way of illustrating the compound of the component (C), mention may be made of the following: isopropyl trioctanoyl titanate, isopropyl tri(dioctylpyrophosphate) titanate, di-2-ethylhexyloxytitanium bisacetylacetonate, n-butoxytitanium monostearate, diisopropoxytitanium bisacetylacetonate, dihydroxytitanium dilactate, dimethacryloxy acetate titanate, triisopropyl monododecylbenzenesulfonyl titanate, tetra(n-propoxy)titanium, tetra(n-botoxy)titanate, di(n-butoxy), di(n-hexyloxy)titanium, tetra(2-ethylhexyloxy)titanate, tetra(n-butoxy)zirconium, and tetra(2-ethylhexyloxy)zirconium. These compounds may be used in combination of two or more.

Among the above examples are included, and preferably used in the invention, chelate compounds in which organic compounds having two or more electron donating groups coordinate with metal ions to form one or more chelate rings. As the compounds which form such chelate compounds are mentioned hydroxyketones, hydroxyaldehydes, ketonic acids and esters thereof, diketones, alcohols having two or more hydroxyl groups, and hydroxy-acids; and more concretely, mention may be made of lactic acid, dihydroxymaleic acid, ethylene glycol, 1,3-butanediol, 2-methylpentane-2,4-diol, diacetone alcohol, pyrogallol, ethyl malonate, and $\beta$-diketones. These chelate compounds can be obtained by mixing and reacting, for example, tetraalkoxy titanate with a compound which forms chelate thereof. They may be used as an isolate, or may be used as a reaction mixture. Among titanium or zirconium compounds, those which have a tetravalent covalent bond but with a vacant coordination position may be coordinated with a suitable ligand. An example is tetraisopropyl bis(dioctylphosphite)titanate.

The use of the above three components, namely an organopolysiloxane, an alkoxy silane cross-linking agent and a titanium or zirconium compound, is essential in this invention. Lack of any one component could not accomplish the objects of this invention.

In addition to those essential components, there may be added various resins which exhibit adhesion to toner, e.g. alkyd resins, urea resins, melamine resins, phenolic resins, epoxy resins, unsaturated polyester resins, epoxyester resins, resins prepared by radical or ionic polymerization such as 1,2-polybutadiene and derivatives thereof as well as acrylate or methacrylate copolymers. Preferably, these polymers have at least two hydroxyl groups on the average within the molecule. These hydroxyl groups are introduced into the polymers usually by copolymerization of a hydroxyl group-containing monomer with another monomer not containing hydroxyl group or by reaction of the polymers with a hydroxyl group-containing compound.

The dry planographic printing plate of this invention is manufactured for example in the following manner.

(1) An organopolysiloxane (component A) and an organic group-containing alkoxy silane (component B) are dissolved using a solvent capable of dissolving both components homogeneously.

The composition ratio of the component A to the component B is as follows: A/B=(199/1) to (40/60) (weight ratio), preferably (98.5/1.5) to (70/30), more preferably (98/2) to (80/20). Usually, the component B is used in smaller amounts than component A.

As the solvent to be used, mention may be made of organic solvents such as hydrocarbons, chlorinated hydrocarbons, esters, ketones, ethers, and alcohols. Above all, n-paraffinic or isoparaffinic hydrocarbons, dichloroethane, butyl acetate, tetrahydrofuran, methyl ethyl ketone, and butyl cellosolve, are preferred. These compounds may be used not only alone but also as a mixture of two or more.

The solvent is preferably used so that the other components dissolved therein is 1 to 50% by weight.

(2) Further, the foregoing organotitanium or organozirconium compound (component C) is added to the solution thus prepared.

The ratio of the component C to the components A and B is as follows: (A+B)/C=(100/0.1) to (100/20) (weight ratio), preferably (100/0.2) to (100/10), more preferably (100/0.4) to (100/5).

When the components A, B and C are dissolved in the solvent, sometimes gelation occurs temporarily resulting in that the entire system loses flowability. This is presumed to be attributable to the composition of the reaction mixture peculiar to this invention.

The gel which does not flow gradually becomes lower in viscosity with the lapse of time and finally reverts to the flowing state that it possessed before formation of gel. The time required for recovery to the original flowing condition is from approximately several hours to sometimes ten odd hours. However, it is also possible to obtain the reaction mixture without going through gelation.

Such gelation does not occur at the time of mixing between an organopolysiloxane and an alkoxy silane cross-linking agent. It occurs when the foregoing organotitanium or organozirconium compound is mixed with the organopolysiloxane. It is presumed that the gelation occurs because of formation of an extremely high molecular weight product as a result of the reaction, such as a three-dimensional network structure. However, the gelation can be avoided by the co-existence of solvents or compounds capable of becoming organic groups or ligands of the organotitanium or organozirconium compound in the invention, such as alcohols and acetylacetone.

(3) The reaction mixture thus obtained is applied uniformly onto a base substrate. Examples of the base substrate used in this invention are papers, plastic films, metallic sheets, synthetic papers (film base and pulp base), sheet-like foams, flexible rubber sheets, non-woven fabrics, woven fabrics (coated with plastics or rubber), and composites of these materials. The base substrate may be subjected beforehand to impregnation or coating treatment with a view to improving the adhesion to the coating film or improving the durability or subjected to coating treatment for imparting any other special functions (for example, giving an electrostatic photographic image recording sheet having a coating layer composed of zinc oxide, sensitizing coloring matter and binder resin). Among the above-enumerated base substrates, paper is preferred from the standpoint of economy, above all, coated papers, particularly coated papers having a smooth surface finished by a supercalender or the like and coated papers cast coated by a mirror-finished cylinder drier are preferred.

Such papers are coated with a finely-divided inorganic filler together with a binder resin and are finished like the mirror surface, having an excellent smoothness and a unique barrier characteristic, and thus are suitable as a printing base substrate.

There are no special limitations on the thickness of the base substrate, but the base substrate should have such a thickness as allows printing to be effected without requiring compulsion when loaded on a printing machine. A thickness of about 5 mm or less is suitable. The lower limit of the thickness depends on the strength of printing plate, so differs according to materials, but a thickness of about 30 microns or more is preferred.

For the application onto the base substrate there may be adopted conventional application techniques such as roll, air knife, doctor blade, slit die, spray, and curtain flow coating. In small-scale experiments there is used an applicator, a bar-coater or a rotational coating machine.

The thickness of the coating film formed on the base substrate is not larger than 20$\mu$, preferably 0.1–10$\mu$ and more preferably 0.2–5$\mu$. The reason for the said upper limit is that coating film thicknesses exceeding 20$\mu$ are disadvantageous from the economic point of view, and the reason for setting such lower limit is that if the thickness is too small, application is difficult and that even if application can be performed, anything below the minimum thickness of the coating film is apt to cause paint stain.

To the coating composition thus applied uniformly onto the base substrate, there may be added various additives as necessary in addition to the essential components, for example, antioxidant, ultraviolet ray absorber and other anti-weathering stabilizers, dyestuffs, organic and/or inorganic fine powder of filler.

As the finely powdered filler, mention may be made of a finely powdered silica, talc, kaolin clay, and a finely powdered high-density polyethylene.

(4) The substantially homogeneous reaction mixture coating film thus formed on the base substrate is subjected to heat treatment simultaneously with and/or after the removal of the solvent. The coated base substrate is then cut into a required size and thus a dry planographic printing plate is produced.

The removal of the solvent is performed after application of the aforesaid reaction mixture usually by natural drying in a gas stream at room temperature or by a forced pneumatic conveying drying. The heat treatment is carried out at a temperature ranging from room temperature to 350° C., preferably from 50° to 300° C. and more preferably from 100° to 250° C., in the air or in an inert gas atmosphere such as nitrogen, argon or carbon dioxide. It may be conducted under a somewhat pressurized condition or under reduced pressure. For the heating there may be used hot air and radiation, and a heating roll is also employable. During heat treatment of the coating film surface or for at least the period of time required for the development of the desired effect, it is necessary to maintain the coating film in a free surface condition. It is not desirable to maintain the coating film surface in a closely covered condition with a smooth plain or curved surface of a film or the like.

The time required for the heat treatment is usually 0.5 to 60 minutes, preferably 1 to 30 minutes.

By the application of such heat treatment the cross-linking reaction within the coating film is completed.

In order to render the printing plate of this invention higher in performance, it is necessary that the reagents and solvent which constitute the coating solution to be applied to the base substrate be purified in advance to a satisfactory extent. The moisture content of the solvent is not higher than 60 ppm, preferably not higher than 30 ppm and most preferably not higher than 15 ppm. Incorporation of a product decomposed or reacted by moisture etc. of the alkoxy silane and titanium or zirconium compound is not desirable. Particularly, formation of an oligomer by polymerization is undesirable. If an impure reagent is used, the cure of the coating layer becomes insufficient or a bleed-out substance may be recognized, resulting in that toning by ink or non-image area may occur at the time of printing, or the plate surface is easily flawed. With the lapse of time, moreover, the bonding force of the toner of the image area after machine plate making becomes lower, so the durability of the printing plate is deteriorated.

The coating film formed as above on the base substrate of the dry planographic printing plate of this invention exhibits superior printing characteristics, and this is for the following reasons.

The composition and structure of the coating film of this invention are considered to be unique, and this uniqueness is derived from the use of the foregoing titanium or zirconium compound. If the composition of this invention is composed of only the two components of an organopolysiloxane and an organic group-containing alkoxy silane cross-linking agent, a substantially cured coating film is not obtained. Only when the foregoing organotitanium compound or organozirconium compound is added as the third component, a cured coating film is obtained, and therefore the said third component can also be considered to be a catalyst. Actually, however, the amount of such third component used is related to the amount of the cross-linking agent, not the small amount generally associated with a catalyst. That is, it is used in an amount corresponding to the amount of the terminal hydroxyl group of the organopolysiloxane. Even with the two-component system of a polysiloxane containing a silanol group at one or both ends thereof and an organotitanium compound or an organozirconium compound, it is possible to obtain a cured coating and a printing plate which exhibits an ink repellency. Such a two-component system, however, is not desirable because the adhesion of toner to the printing plate (and hence the printing endurance) is insufficient, and further the printing plate becomes deteriorated with the lapse of time.

The three components of the coating composition of this invention are essential. Lack of any one component could not afford a satisfactory result.

In general, a printing plate having an undercured coating film surface is superior in the adhesion to toner in many cases, but this is temporary; that is, with the lapse of time the adhesion to toner lowers to the extent that the printing plate is no longer practicably useable. In the case of the printing plate of this invention, such a problem does not occur.

That the printing plate of this invention exhibits superior performances is presumed to be ascribable to the unique coating film composition and the resulting plate surface structure. More particularly, it is presumed that the reaction product between the cross-linking agent and the organotitanium or organozirconium compound is present as an island component having an adhesion to toner and in a dispersed state as fine particles in the sea component of the cross-linked organopolysiloxane. Such an heterogeneous structure is considered to be one reason for the co-existence of the adhesion to toner and the ink repellency.

The printing plate of this invention has superior image-forming property and stability particularly in the image formation by an electrostatic photography type copying machine or the like. In the printing without using dampening water, the resulting imaged printing plate has a high durability with little background contamination.

The following description is now provided to show the manner in which an image is formed on such a printing plate and how to prepare an imaged printing plate for use as a machine plate in printings.

The image formation usually is effected by the use of an electrophotography type copying machine or plate making machine. The copying machine to be used is for PPC (Plain Paper Copy) or CPC (Coated Paper Copy) according to the performance of the printing plate of this invention. Either wet or dry development may be used in the copying machine or plate making machine.

As the toner there may be used those which are presently used in plate making machines or copying machines, and also known ones described in literatures. Various thermoplastic resins, heat-softening resins and thermal pressure-deforming resins may be used for the toner such as, for example, epoxy resins, styrene-polybutadiene resins, phenolic resins and alkyd resins.

Without using the technique of electrophotography, it is also possible to form image by the direct image forming method in which machine plate is made using various tools and apparatus, for example, handwriting with a magic ink, describing with an iron needle, or the use of a typewriter.

The machine plate may undergo various treatments for its advantageous use in printing. As an example, in order to improve the fixing of toner, there may be applied heat treatment for 1 second to 10 minutes, preferably 2 seconds to 5 minutes, at a temperature above the melting point of the toner (e.g. 60°-350° C., preferably 100°-250° C.). This heat treatment may be carried out under pressure.

As another treatment, there also may be applied calendering (sometimes heat treatment is also conducted at the same time) to improve the durability, whereby the toner image is embedded into the coating layer of the plate.

The correction of image can be done in known manner, for example, by the removal of toner before or after fixing, using organic solvents such as methanol, acetone etc. by a physical scraping-off of toner image after fixing, or by the application of an ink repellent silicone composition (correcting solution) onto the image.

The imaged printing plate thus obtained is loaded on a planographic printing machine and is used for printing while using paper and ink and not using dampening water. As the printing machine there may be used an offset press of the type known in the industry or a printing machine of the direct printing type without blanket cylinder. In the case of conducting a multicolor printing, the in-house or in-plant dry printing system can enjoy the essential advantages resulting from the absence of water; that is, there is neither elongation of the printing plate nor elongation of the printing paper by dampening water, and there is no color shift in the resulting printed matter. Machine plates of image formed by color separation process into various color components are simultaneously attached to a multicolor press and are used for the printing of a color image. Such machine plates of various colors may be attached not simultaneously, but in order, to the same printing machine, in which multicolor printing can be done by the repetition of printing on the same paper. There may be used known inks which have heretofore been used in planographic printing. Some of the inks have an affinity too strong for the non-image area so print contamination is unavoidable, but in some cases such an inconvenience can be remedied by the addition of a silicone oil or a silicone modified resin. The amount of a silicone oil or a silicone modified resin to be added to the ink is not more than 10%, preferably 0.3% to 3%, based on the total amount. As to the printing paper, there may be used those capable of being used in planographic printing process using dampening water such as a waterproof converted paper in addition to art paper, coated paper, wood free paper, medium and low grade papers. Dry printing can afford satisfactory results even for articles which in the presence of dampening water would be difficult to print in good finish, such as films having a hydrophobic surface, plastics and metals.

The dry planographic printing plate of this invention has various other characteristics. For example, a machine plate which has been used for printing can be used again as a printing plate. More concretely, the toner image is removed with a solvent, then another image is formed thereon and printing is made. Thus the same plate can be used repeatedly. Furthermore, a printing plate with a toner image once used can be used for printing again with just the same image quality. Such a re-use is usually impossible in the case of a paper planographic printing plate using dampening water. Further, even when the printing machine stops operation halfway in printing, no trouble occurs in the method of this invention, after the lapse of a suitable time, printing can be re-started without any trouble. In the case of a wet planographic printing, the plate surface dries due to evaporation of the dampening water, and it is impossible to re-start printing in the same condition as before the suspension. And even if printing is re-started, the quality of the resulting printed matter is in many cases deteriorated. Adjustment of dampening water requires not only a delicate adjustment of mechanical operations but also adjustment of the atmospheric conditions of the room where the printing machine is used. To be more specific, in order to prevent the evaporation of dampening water, atmospheres involving temperatures exceeding 30° C. are not desirable, and in order to avoid emulsifying with ink, temperatures below 10° C. are not desirable. In the printing according to this invention, such restrictions can essentially be avoided since the provision of dampening water is not needed. Thus it can be said that the printing method according to this invention is an energy-saving printing method having a wide adaptability.

Working examples of this invention are given below, but it is to be understood that the invention is not limited to the scope of these examples.

All the parts used in the following examples represent parts by weight.

EXAMPLE 1

A silicone-containing composition was applied onto a base substrate made of paper to prepare a dry planographic printing plate. The composition of the coating solution was as follows.

a. Dimethyl polysiloxane (a product of Toray Silicone Co., containing a terminal silanol group, having an average molecular weight of 22,000): 100 parts
b. γ-Glycidoxypropyl trimethoxy silane (a product of Toray Silicone Co.): 6 parts
c. Tetrabutoxy titanium: 1 part
d. "Iso Par E"(a product of Esso Chemical Co.): 963 parts These reagents gelled on thorough mixing, but this condition was temporary and with the lapse of time the viscosity lowered to the extent that application was possible. The base paper substrate used was a cast coated paper (trade name: Mirror Coated Paper "Gold", a product of Kanzaki Paper Mfg., Co., basis weight 127 g/m$^2$), onto which was applied the coating solution after the lapse of 17 hours after its preparation by means of a bar-coater so that the coating film thickness after drying was about 2μ. Thereafter, the coated base substrate was air-dried and then heat-treated for 5 minutes in a hot air oven at 160° C., and thus a printing plate was produced.

The printing plate was cut into the B4 size (225 mm×390 mm), on which was then formed a toner image using a copying machine. The resin of the toner consisted mainly of an epoxy polymer, and the copying machine used was Canon NP 5100, which is of the so-called PPC (Plain Paper Copy) type wherein toner image is transferred onto an ordinary paper. The toner image transferred onto the printing plate surface was fixed by means of an infrared heating type fuser, and thus a machine plate was obtained.

The machine plate was attached to an offset press (A. B. Dick Model 320, a desk type) and printing was made using "Gans" ink (black, for in-house printing, a product of Gans Ink & Supply Co.). As a result, there were obtained more than 1,000 printed sheets (printed on fine paper or medium grade paper) having a clear image free from toning by ink on non-image area. The ink was prepared by kneading 3% silicone oil with the Gans ink.

COMPARATIVE EXAMPLE 1

The procedure of Example 1 was repeated except that γ-glycidoxypropyl trimethoxy silane or tetrabutoxy titanium was omitted from the three components of dimethyl polysiloxane, γ-glycidoxypropyl trimethoxy silane and tetrabutoxy titanium, and the resulting two-component system was used. As a result, the coating film of the machine plate thereby obtained was not fully cured.

COMPARATIVE EXAMPLE 2

From the three-component composition used in Example 1, tetrabutoxy titanium was omitted and instead dibutyl tin diacetate or dibutyl tin dilaurate was added in the same amount, and printing was made under the same conditions as in Example 1 and the results were evaluated. There was obtained only a printed matter having a gross toning by ink on non-image area.

EXAMPLE 2

A dry planographic printing plate was obtained by applying a silicone-containing composition onto a base substrate made of paper. In the preparation of the coating solution, the amount of dimethyl polysiloxane was made constant, while the amount of cross-linking agent and that of catalyst were varied; that is, 5, 10, 15 and 20 parts of γ-glycidoxypropyl trimethoxy silane and 0.8, 1.6, 2.4 and 3.2 parts of tetrabutoxy titanate were used for the constant amount of 100 parts of dimethyl polysiloxane.

Just the same reagents as in Example 1 were used and adjustment was made so that the total weight of the three components, dimethyl polysiloxane, γ-glycidoxypropyl trimethoxy silane and tetrabutoxy titanium, was 10% by weight in the solution. The manufacturing conditions for the dry planographic printing plate were absolutely the same as in Example 1. Using this printing plate and, like Example 1, using the Canon NP 5100 copying press, development was made with the epoxy resin toner followed by fixing by means of the fuser, to obtain a machine plate. This machine plate was attached to A. B. Dick offset press, and a printing test was conducted using Schmidt Photo Direct Ink (black, a product of Schmidt Printing Ink Co., with 2% silicone oil added). In all of the cases, there was no toning by ink on non-image area, and more than 1,000 sheets could be printed. The printed matters were of high quality, employable from the first sheets thereof. The blanket was free from stain because of good ink repellency of the non-image area of the machine plate.

EXAMPLE 3

A printing plate was manufactured using the same composition, amount of use and plate manufacturing conditions as in Example 1 except that tetrapropoxy titanium was used as catalyst in place of tetrabutoxy titanium. The coating film of the printing plate was about 3μ thick, and the coating solution after drying was subjected to heat treatment at 180° C. for 5 minutes. The image formation was effected using Xerox 3103 machine, and the toner image was heat-treated and fixed in a hot air oven at 120° C. for 1 minute. Printing was made using the same printing press and ink as those used in Example 1. From the first sheet of the printed matter there was obtained a clear one free from toning by ink on non-image area, and about 500 printed sheets of high quality could be obtained. The durability of the toner image was a little more conspicuous than in the use of tetrabutoxy titanate as catalyst.

EXAMPLE 4

A printing plate was manufactured with varying amounts of cross-linking agent or catalyst. The method of preparing a coating solution and the drying and heat treatment conditions were the same as in Example 1. The coating solution was prepared by the system consisting of 100 parts of dimethyl polysiloxane (the same compound as that used in Example 1), 1, 3 or 10 parts γ-glycidoxypropyl trimethoxy silane as a cross-linking agent and 1 part of tetrabutoxy titanium as a catalyst, or the system consisting of 100 parts of the dimethyl polysiloxane, 6 parts of the above cross-linking agent and 0.1, 1, 3 or 6 parts of the above catalyst. As the base paper substrate there was used the Mirror Coated Paper "Gold" described in Example 1. The thickness of the coating film was about 3μ. The image formation was effected in the same manner as in Example 1, and printing was made using the same ink as that used in Example 1 by means of A. B. Dick 309 printing press. In view of the quality of the printed matter at the beginning of printing, the falling-off degree of the toner image area and the degee of stain of the printed matter, all machine plates other than that of the system in which the amount of catalyst was 0.1 part, afforded good printed matters up to 500 sheets. In the machine plate made from the system in which the catalyst amount was 0.1 part, there was somewhat recognized stain in the printed matter from the beginning of printing, and when 500 sheets were printed there was somewhat observed falling-off of toner at the image area.

When the above three components of dimethyl polysiloxane, cross-linking agent and catalyst were mixed together in "Iso Par E", the mixture gelled, but on the next day after passing one night the mixture was fluidized to an applicable extent. In this case, it was found that if butanol is added into the solvent Iso Part, the gelation of the system is suppressed. For example, butanol is incorporated in the solvent about 3% to 30% by weight. Even when butanol (generally alcohols) is added, the performance of the dry planographic printing plate never changes.

EXAMPLE 5

As the silicone compound there was used a terminal hydroxyl group-containing silicone rubber (dimethyl polysiloxane manufactured by Toray Silicone Co.) or a vinyl group- and terminal hydroxyl group-containing dimethyl polysiloxane (a product of Toray Silicone Co., vinyl group content 20 mol%, molecular weight 22,800), as the cross-linking agent there was used γ-glycidoxypropyl trimethoxy silane and as the catalyst there was used tetrabutoxy titanium. The conditions for the preparation, application, drying and heat treatment of a coating solution were the same as in Example 1.

The above systems were of the following component weight ratios: silicone rubber/cross-linking agent-/catalyst = 100/1.7/0.3 and vinyl group-containing dimethyl polysiloxane/cross-linking agent-/catalyst = 100/5.8/1.0.

The image formation and printing were carried out in the same manner as in Example 1, resulting in that from the machine plate of the system using silicone rubber there were obtained 500 printed sheets of high quality free from toning by ink on non-image area, while the machine plate made from the system using the vinyl group-containing dimethyl polysiloxane there was observed a slight toning by ink on non-image area at the beginning of printing, but thereafter there were obtained 1,000 printed sheets of high quality.

EXAMPLE 6

A printing plate was manufactured in the same manner as in Example 1 except that tetrabutoxy zirconium was used in place of tetrabutoxy titanate. After image formation, a printing test was conducted. In the printing there were obtained about the same results as in the use of tetrapropoxy titanate, and about 500 printed sheets of high quality were obtained.

EXAMPLE 7

A printing plate was manufactured in the same manner as in Example 1 except that β-(3,4-epoxycyclohexyl)ethyl trimethoxy silane was used as a cross-linking agent in place of γ-glycidoxypropyl trimethoxy silane. After image formation, a printing test was conducted under the same conditions as in Example 1 except that the Schmidt Photo Direct Ink (with silicone oil not added) described in Example 2 was used as a printing ink. In the printing, toning by ink on non-image area was somewhat liable to occur, but there could be obtained about 800 printed sheets of high quality.

EXAMPLE 8

A printing plate was manufactured in the same manner as in Example 1 except that tetrakis(2-ethylhexyloxy)titanium was used in place of tetrabutoxy titanate. After image formation, a printing test was conducted, in which there were obtained about the same results as in the use of tetrabutoxy titanate.

EXAMPLE 9

Dry planographic printing plates were manufactured by applying silicone-containing compositions onto a base paper substrate. The coating solution were of the following compositions.

a. Dimethyl polysiloxane (a product of Toray Silicone Co., containing a terminal silanol group, having an average molecular weight of 22,000): 100 parts
b. Various trialkoxy silanes as shown below: 6 parts
c. Di-i-propoxytitanium bisacetylacetonate ("Tita bond-50", a product of Nippon Soda Co.): 1 part
d. "Iso Par E" (a product of Esso Chemical Co.):963 parts The following trialkoxy silane cross-linking agents were used.

γ-Glycidoxypropyl trimethoxy silane (SH 6040, a product of Toray Silicone Co.)
γ-Methacryloxypropyl trimethoxy silane (KBM 503, a product of The Shin-etsu Chemical Industry Co.)
γ-(aminoethyl)aminopropyl trimethoxy silane (SH 6020, a product of Toray Silicone Co.)
γ-Chloropropyl trimethoxy silane (SH 6076, a product of Toray Silicone Co.)
γ-Mercaptopropyl trimethoxy silane (SH 6062, a product of Toray Silicone Co.)
Phenyl trimethoxy silane (KBM 103, a product of The Shin-etsu Chemical Industry Co.)

The above components a–d were mixed together, resulting in that with the lapse of time the viscosity of the system somewhat increased, but became constant within 1 hour. As the base substrate there was used a cast coated paper (trade name: Mirror Coated Paper "Gold", a product of Kanzaki Paper Mfg. Co., basis weight 127 g/m$^2$), onto which was applied the foregoing coating solution by means of a bar-coater so that the thickness of the coating film after drying was about 3 microns. Thereafter, the base substrate so-coated was air-dried and then subjected to heat treatment in a hot air oven at 160° C. for 5 minutes. In this way there could be obtained printing plates having a cured coating film.

On the printing plates was then formed image by means of a copying machine which was a dry PPC type Xerox 3103, and thus machine plates were obtained. The toner image transferred onto the plate surface was fixed by means of an infrared heating type fuser.

The machine plates were attached to an offset press (A. B. Dick 310, a desk type) and printing was performed using a modified "Gans" ink (black, for in-house printing, a product of Gans Ink & Supply Co.) and without using dampening water, resulting in that in any of the cross-linking agents there were obtained more than 500 printed sheets (wood free paper or medium grade paper) of good quality free from toning by ink on non-image area and having a clear image.

On the other hand, the cross-linking agents were used not alone but as a 1/liter mixture of two kinds of cross-linking agents; that is, SH 6062 was mixed with SH 6040, SH 6076 or KBM 103, and KBM 503 was mixed with SH 6040, SH 6076 or KBM 103. As a result, in all the cases there were obtained printing plates having a cured coating film, and it was found that the same printing results as above were obtainable.

EXAMPLE 10

Dry planographic printing plates were manufactured by applying silicone-containing compositions onto a base paper substrate. The coating solutions were of the following compositions.

a. Dimethyl polysiloxane (the same as in Example 9): 100 parts

γ-Glycidoxypropyl trimethoxy silane (SH 6040, a product of Toray Silicone Co.): 6 parts c. Various organotitanium compounds as shown below: 1 part d. "Iso Par E" (a product of Esso Chemical Co.): 963 parts The following organotitanium compounds were used.

Isopropyl trioctanoyl titanate (KEN-REACT KR-TTS-B, a product of Kenrich Petrochemicals, Inc.)

Isopropyl tri(dioctylpyrophosphate)titanate (KR-38S, a product of Kenrich Petrochemicals, Inc.) or tetraoctyl di(ditridecylphosphite)titanate (KR-46, a product of the same company)

The above components a–d were mixed together to prepare coating solutions, which were then applied onto the cast coated paper in the same manner as in Example 9, followed by drying and curing, resulting in that in all the cases there could be obtained printing plates having a cured coating film.

On the printing plates was then formed image, thereafter printing was made and the results evaluated to find that more than 500 printed sheets of good quality were obtained.

EXAMPLE 11

Dry planographic printing plates were manufactured by applying silicone-containing compositions onto a base paper substrate. The coating solutions were of the following compositions.

a. Dimethyl polysiloxane (the same in Example 9): 100 parts b. γ-Glycidoxypropyl trimethoxy silane (the same as in Example 10): 6 parts c. Various titanium chelate compounds as shown below: 1 part d. "Iso Par E" (the same as in Example 9): 963 parts As the titanium chelate compounds there were used mixtures resulting from reaction by adding 2 mols/(tetrabutoxy titanate 1 mol) of various chelating agents into a solution of tetrabutoxy titanate in "Iso Par E", in which acetylacetone, catechol, diacetone alcohol or 1,3-butanediol was used as a chelating agent.

The above components a–d were mixed together to prepare coating solution and the procedure of Example 9 was repeated, resulting in that in all the cases there could be obtained printing plates having a cured coating film. On the printing plates was then formed image in the same manner as in Example 9, thereafter printing was made and the results evaluated to find that more than 500 printed sheets of high quality free from toning by ink on non-image area could be obtained.

It was found that in the case of using such reaction mixtures as chelate compounds, as compared with the use of tetrabutoxy titanate, the resulting coating solution are more stable to moisture and that the time required for the coating film to cure is shortened.

EXAMPLE 12

Dry planographic printing plates were manufactured by applying compositions containing silicones of different molecular weights onto a base paper substrate. The coating solutions were of the following compositions.

a. Various dimethyl polysiloxanes (a product of Toray Silicone Co., containing a terminal silanol group): 100 parts b. γ-Glycidoxypropyl trimethoxy silane (the same as in Example 10): suitable part c. Di-i-propoxy bis(acetylacetonate)titanium (the same as in Example 9): suitable part d. "Iso Par E" (the same as in Example 9): suitable part "Iso Par E" was added in an amount such that the total amount of a, b and c was 15% by weight in the coating solution.

The dimethyl polysiloxanes used were different in number average molecular weight. Their molecular weights and amounts are tabulated below together with the amounts of the cross-linking agent (b) and catalyst (c).

| Silicone (a) | | | Cross-linking agent (b) | Catalyst (c) |
|---|---|---|---|---|
| Kind | Avg. mol. wt. | Part | Part | Part |
| A | 50,000 | 100 | 2.75 | 0.55 |
| B | 18,000 | 100 | 6.1 | 1.2 |
| C | 3,000 | 100 | 36.7 | 7.3 |
| D | 1,000 | 100 | 110 | 22 |
| 3:1 mixture of the silicone in Ex. 9 and D | 3,500 | 100 | 31.3 | 6.3 |

The above components a–d were mixed together to prepare coating solution, which were then applied onto the cast coated paper in the same manner as in Example 9, followed by drying and curing, resulting in that in all the cases there could be obtained printing plates having a cured coating film. However, the coating solutions containing low molecular weight silicones showed the tendency that their viscosity became low and that their application in uniform thickness was difficult, and even permeation thereof into the base substrate was observed. In the use of the silicone D, the smoothness of the plate surface was somewhat inferior.

On the printing plates thus obtained was formed image in the same way as in Example 9, then printing was made and the results evaluated to find that more than 500 printed sheets of good quality were obtained. The coating solutions containing silicones with molecular weights higher than a certain degree, i.e. A, B and C, were superior in that there was little toning by ink on non-image area, while the machine plate from the coating solution containing the silicone D was somewhat apt to cause toning by ink on non-image area, but proved to afford a practially employable printed matter if the printing conditions are suitably changed.

The organotitanium compound (c) is used in an amount corresponding to the cross-linking agent (b) and with a molar number corresponding to the terminal hydroxyl group of the dimethyl polysiloxane, so it can be regarded also as a cross-linking agent like (b) rather than regarded as a catalyst.

EXAMPLE 13

In the manufacture of a dry planographic printing plate by applying a dimethyl polysiloxane-containing composition onto a base paper substrate, the coating film curing temperature and time were changed. The composition of the coating solution was as follows.

a. Dimethyl polysiloxane (the same as in Example 9): 100 parts
b. γ-Glycidoxypropyl trimethoxy silane (the same as in Example 10): 5 parts
c. Di-i-propoxy bis(acetylacetonate)titanium (the same as in Example 10): 1 part
d. "Iso Par E" (the same as in Example 9): 964 parts The above components a–d were mixed together to prepare a coating solution, which was then applied onto a cast coated paper ("Platina", a product of Kanzaki Paper Mfg. Co., basis weight 157 g/m$^2$) in the same manner as in Example 9 and, after drying, was cured under various temperature and time conditions of 110° C., 140° C., 160° C., 180° C., 200° C. and 1 to 5 minutes. In all the cases there could be obtained printing plates having a cured coating film, with no difference recognized in the strength of the coating films. On the printing plates thus obtained was formed image in the same amount as in Example 9, then printing was made and the results evaluated to find that more than 500 printed sheets of good quality were obtained with respect to all of the machine plates.

EXAMPLE 14

The dimethyl polysiloxane used in Example 9, the cross-linking agent used in Example 10 and a tetrabutoxy zirconium reaction mixture obtained by the addition and reaction of 1 mol acetylacetone (the tetrabutoxy zirconium being TBZR, a product of Nippon Soda C.), in the ratio of 100/5/1 (part by weight), were dissolved in "Iso Par E" to make up a 10wt.% solution thereof, which was then applied onto the cast coated paper in the same manner as in Example 9, followed by drying and curing, resulting in a printing plate with a cured coating film. Then in the same way as in Example 9 the image formation and printing were carried out, and there were obtained more than 500 printed sheets free from toning by ink on non-image area and free from falling-off of toner.

EXAMPLE 15

As a dimethyl polysiloxane there was used a mixture with a number average molecular weight of $5\times10^4$ consisting of 30% polymer with methyl group at one end and hydroxyl group at the other and the balance polymer with hydroxyl groups at both ends; and as a cross-linking agent there was used γ-glycidoxypropyl trimethoxy silane (the same as in Example 10); and as an organotitanium compound there was used di-i-propoxytitanium bis(acetylacetonate) (the same as in Example 9). A 100/5/1 (weight ratio) composition consisting of these three components was dissolved in "Iso Par E" to prepare a 15% solution thereof, which was then applied onto the cast coated paper in the same manner as in Example 9, followed by drying and curing, to obtain a printing plate having a cured coating film. Then in the same way as in Example 9 there was formed image on the printing plate, thereafter printing was made and the results evaluated to find that more than 500 printed sheets of good quality were obtained.

EXAMPLE 16

Dry planographic printing plates were manufactured by applying silicone-containing compositions onto a base paper substrate. The coating solutions were of the following compositions.

a. Dimethyl polysiloxane (a product of Toray Silicone Co., containing a terminal silanol group, having an average molecular weight of 22,000): 100 parts
b. Various trialkoxy silanes: 5 parts
c. Tetrabutoxy titanium: 1 part
d. "Iso Par E" (a product of Esso Chemical Co.): 600 parts The following trialkoxy silane cross-linking agents were used: γ-chloropropyl trimethoxy silane (SH 6076, a product of Toray Silicone Co.), phenyl trimethoxy silane (KBM 103, a product of The Shin-etsu Chemical Industry Co.), γ-methacryloxypropyl trimethoxy silane (KBM 503, a product of The Shin-etsu Chemical Industry Co.), and γ-mercaptopropyl trimethoxy silane (SH 6062, a product of Toray Silicone Co.).

When the above components a–d were mixed together, the viscosity of the system increased, but on standing for a while it became constant.

As the base substrate there was used a cast coated paper (trade name: Mirror Coated Paper "Gold", a product of Kanzaki Paper Mfg. Co., weight 127 g/m$^2$), onto which were applied the foregoing coating solutions by means of a #12 bar-coater so that the thickness of the coating film after drying was about 3μ. Thereafter, the coated substrates were air-dried and then heat-treated for 5 minutes in a hot air drying machine at 160° C., resulting in that there could be obtained printing plates having a cured coating film.

On the printing plates thus obtained was formed image by means of Xerox 3103 copying machine (a dry PPC type, a product of Fuji-Xerox Co.), and thus machine plates were obtained. The toner image transferred onto the plate surface was fixed by heating in a hot air oven at 160° C. for 1 minute.

The machine plates were attached to a small-sized offset press (A. B. Dick 310, a desk type), then printing was made using "Schmidt" ink (black, for in-house printing, a product of Schmidt Printing Ink Co.) which had been modified by the addition of silicone, resulting in that in the use of any cross-linking agent there could be obtained more than 500 printed sheets of good quality having a clear image free from toning by ink on non-image area.

EXAMPLE 17

A printing plate was manufactured in the same manner as in Example 16 except that tetrabutoxy zirconium was used in place of tetrabutoxy titanium and that γ-chloropropyl trimethoxy silane was used as a cross-linking agent. The image formation and printing were carried out also in the same way as in Example 16. As a result, there were obtained 500 printed sheets of high quality.

We claim:

1. A dry planographic printing plate which comprises a base substrate and an ink repellent silicone layer overlying the substrate, said silicone layer comprises a mixture of (A) an organopolysiloxane;

(B) an alkoxy silane represented by the formula $$R_{4-a-b}R'_aSi(OR'')_b$$

wherein R is an organic group having 1 to 18 carbon atoms which contains a member selected from the group consisting of an olefinically unsaturated hydrocarbon group, an aromatic hydrocarbon group and a polar group which does not react with the OR'' at room temperature, R' is an alkyl or alicyclic group having 1 to 18 carbon atoms, OR'' is an alkoxy group having 1 to 8 carbon atoms, a is 0 or 1, b is 2 or 3, and a+b is at most 3; and (C) a titanium or a zirconium compound represented by the formula $$(R^1O)(R^2O)(R^3O)(R^4O)M$$

wherein $R^1$, $R^2$, $R^3$, $R^4$ are each an organic group having 1 to 18 carbon atoms or an organic group having 1 to 18 carbon atoms containing a residue of >C=O,

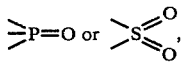

by which the group is bonded to the oxygen atom, and M is titanium or zirconium.

2. The dry planographic printing plate as defined in claim 1, in which said organopolysiloxane is a diorganopolysiloxane containing a silanol group at one or both ends thereof.

3. The dry planographic printing plate as defined in claim 1, in which R of said alkoxy silane is vinyl, alkyl, phenyl, or vinylphenyl.

4. The dry planographic printing plate as defined in claim 1, in which R of said alkoxy silane is a hydrocarbon group containing amino, epoxy, acyclic ether, hydroxyl, carboxyl, ester, carbonyl, mercapto, halogen, nitrile or imino group.

5. The dry planographic printing plate as defined in claim 1, in which $R^1$, $R^2$, $R^3$ and $R^4$ in said titanium or zirconium compound, which may be alike or different, are each a hydrocarbon group having 1 to 12 carbon atoms.

6. The dry planographic printing plate as defined in claim 1, in which $R^1$, $R^2$, $R^3$ and $R^4$ in said titanium or zirconium compound, which may be alike or different, are each an alkyl group having 1 to 12 carbon atoms.

7. The dry planographic printing plate as defined in claim 1, in which at least one of $R^1$, $R^2$, $R^3$ and $R^4$ in said titanium or zirconium compound is a hydrocarbon group having 1 to 12 carbon atoms and containing the residue of >C=O,

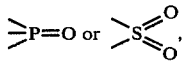

by which the group is bonded to the oxygen atom.

8. The dry planographic printing plate as defined in claim 1, in which the ratio of said organopolysiloxane (A) to said alkoxy silane (B) is A/B=199/1 to 40/60 (in weight ratio).

9. The dry planographic printing plate as defined in claim 1, in which the ratio of said organopolysiloxane (A) to said alkoxy silane (B) is A/B=98.5/1.5 to 70/30 (in weight ratio).

10. The dry planographic printing plate as defined in claim 1, in which the ratio of said organopolysiloxane (A) and said alkoxy silane (B) to said titanium or zirconium compound (C) is (A+B)/C=100/0.1 to 100/20 (in weight ratio).

11. The dry planographic printing plate as defined in claim 1, in which the ratio of said organopolysiloxane (A) and said alkoxy silane (B) to said titanium or zirconium compound (C) is (A+B)/C=100/0.2 to 100/10 (in weight ratio).

* * * * *